US010401886B1

(12) United States Patent
Melanson et al.

(10) Patent No.: US 10,401,886 B1
(45) Date of Patent: Sep. 3, 2019

(54) SYSTEMS AND METHODS FOR PROVIDING AN AUTO-CALIBRATED VOLTAGE REFERENCE

(71) Applicant: Cirrus Logic, Inc., Austin, TX (US)

(72) Inventors: John L. Melanson, Austin, TX (US); Rahul Singh, Austin, TX (US); Prashanth Drakshappalli, Austin, TX (US); Dale Brummel, Spicewood, TX (US)

(73) Assignee: Cirrus Logic, Inc., Austin, TX (US)

( * ) Notice: Subject to any disclaimer, the term of this patent is extended or adjusted under 35 U.S.C. 154(b) by 482 days.

(21) Appl. No.: 14/813,549

(22) Filed: Jul. 30, 2015

Related U.S. Application Data

(60) Provisional application No. 62/031,056, filed on Jul. 30, 2014.

(51) Int. Cl.
*G05F 1/565* (2006.01)
*G05F 1/46* (2006.01)
*G05F 1/56* (2006.01)

(52) U.S. Cl.
CPC ..... *G05F 1/56* (2013.01); *G05F 1/462* (2013.01); *G05F 1/468* (2013.01); *G05F 1/565* (2013.01)

(58) Field of Classification Search
CPC ... G05F 1/10; G05F 1/46; G05F 1/462; G05F 1/463; G05F 1/468; G05F 1/56; G05F 1/565; G05F 1/567; G05F 1/569
USPC ..... 323/234, 265, 273, 281
See application file for complete search history.

(56) References Cited

U.S. PATENT DOCUMENTS 5,280,455 A * 1/1994 Kanaishi ..... G11C 5/147 307/64
5,283,515 A * 2/1994 Jordan ..... H03K 4/502 323/288
7,164,997 B2 * 1/2007 Batra ..... G06F 13/4072 323/281
7,397,228 B2 * 7/2008 Barrows ..... G06F 1/26 323/282
7,525,338 B2 * 4/2009 Nguyen ..... H03K 19/0005 326/27
7,557,550 B2 * 7/2009 Mellachurvu ..... G05F 1/575 323/281
7,728,575 B1 * 6/2010 Ozalevli ..... G05F 3/30 323/313
8,446,141 B1 * 5/2013 McGinn ..... G05F 3/30 323/313
2004/0066180 A1 * 4/2004 Harrison ..... G05F 3/267 323/312
2008/0001623 A1 * 1/2008 Kim ..... H03K 19/0005 326/30

(Continued)

*Primary Examiner* — Yusef A Ahmed
*Assistant Examiner* — David A. Singh
(74) *Attorney, Agent, or Firm* — Jackson Walker L.L.P.

(57) ABSTRACT

A system may include a first voltage reference for generating a first voltage for operating a circuit, a second voltage reference having a higher precision than the first voltage reference, and a controller. The controller may be configured to determine a presence or an absence of a condition for calibrating the first voltage reference. The controller may also be configured to, responsive to the presence of the condition, enable the second voltage reference to generate a second voltage for calibrating the first voltage reference. The controller may further be configured to, responsive to the absence of the condition, disable the second voltage reference.

13 Claims, 4 Drawing Sheets

(56) References Cited

U.S. PATENT DOCUMENTS

| | | | | |
|---|---|---|---|---|
| 2008/0191790 | A1* | 8/2008 | Brox | G05F 1/465<br>327/540 |
| 2010/0156519 | A1* | 6/2010 | Cremonesi | G05F 1/46<br>327/539 |
| 2012/0062275 | A1* | 3/2012 | Hiraki | H03K 19/017545<br>326/30 |
| 2012/0235488 | A1* | 9/2012 | Hamanaka | H02M 1/32<br>307/64 |
| 2013/0093505 | A1* | 4/2013 | Gupta | G05F 1/575<br>327/540 |
| 2013/0154866 | A1* | 6/2013 | Fabregas | H03M 1/12<br>341/158 |
| 2015/0102791 | A1* | 4/2015 | Haider | G05F 1/46<br>323/281 |
| 2015/0205312 | A1* | 7/2015 | Hyun | G05F 1/468<br>327/540 |
| 2016/0041571 | A1* | 2/2016 | Kochkin | G05F 3/30<br>323/312 |

* cited by examiner

SYSTEMS AND METHODS FOR PROVIDING AN AUTO-CALIBRATED VOLTAGE REFERENCE

RELATED APPLICATION

The present disclosure claims priority to U.S. Provisional Patent Application Ser. No. 62/031,056, filed Jul. 30, 2014, which is incorporated by reference herein in its entirety.

FIELD OF DISCLOSURE

The present disclosure relates in general to electrical and electronic circuits, and more particularly to an auto-calibrated voltage reference for use in electrical and electronic circuits.

BACKGROUND

In many applications, it is desirable to provide a well-regulated constant voltage reference for use by one or more electrical or electronic circuits (e.g., to a delta-sigma modulator, analog-to-digital converter, or digital-to-analog converter). However, providing such a voltage reference with high precision may consume significant amounts of power, which may be undesirable in many applications, particularly those that rely on batteries for operation.

SUMMARY

In accordance with the teachings of the present disclosure, one or more disadvantages and problems associated with providing an accurate reference voltage may be reduced or eliminated.

In accordance with embodiments of the present disclosure, a controller may be configured to determine a presence or an absence of a condition for calibrating a first voltage reference for generating a first voltage for operating a circuit, responsive to the presence of the condition, enable a second voltage reference to generate a second voltage for calibrating the first voltage reference, wherein the second voltage reference has a higher precision than the first voltage reference, and responsive to the absence of the condition, disable the second voltage reference.

In accordance with these and other embodiments of the present disclosure, a method may include determining a presence or an absence of a condition for calibrating a first voltage reference, the first voltage reference for generating a first voltage for operating a circuit. The method may also include responsive to the presence of the condition, enabling a second voltage reference to generate a second voltage for calibrating the first voltage reference, the second voltage reference having higher precision than the first voltage reference. The method may further include, responsive to the absence of the condition, disabling the second voltage reference.

In accordance with these and other embodiments of the present disclosure, a system may include a first voltage reference for generating a first voltage for operating a circuit, a second voltage reference having higher precision than the first voltage reference, and a controller. The controller may be configured to determine a presence or an absence of a condition for calibrating the first voltage reference. The controller may also be configured to, responsive to the presence of the condition, enable the second voltage reference to generate a second voltage for calibrating the first voltage reference. The controller may further be configured to, responsive to the absence of the condition, disable the second voltage reference.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
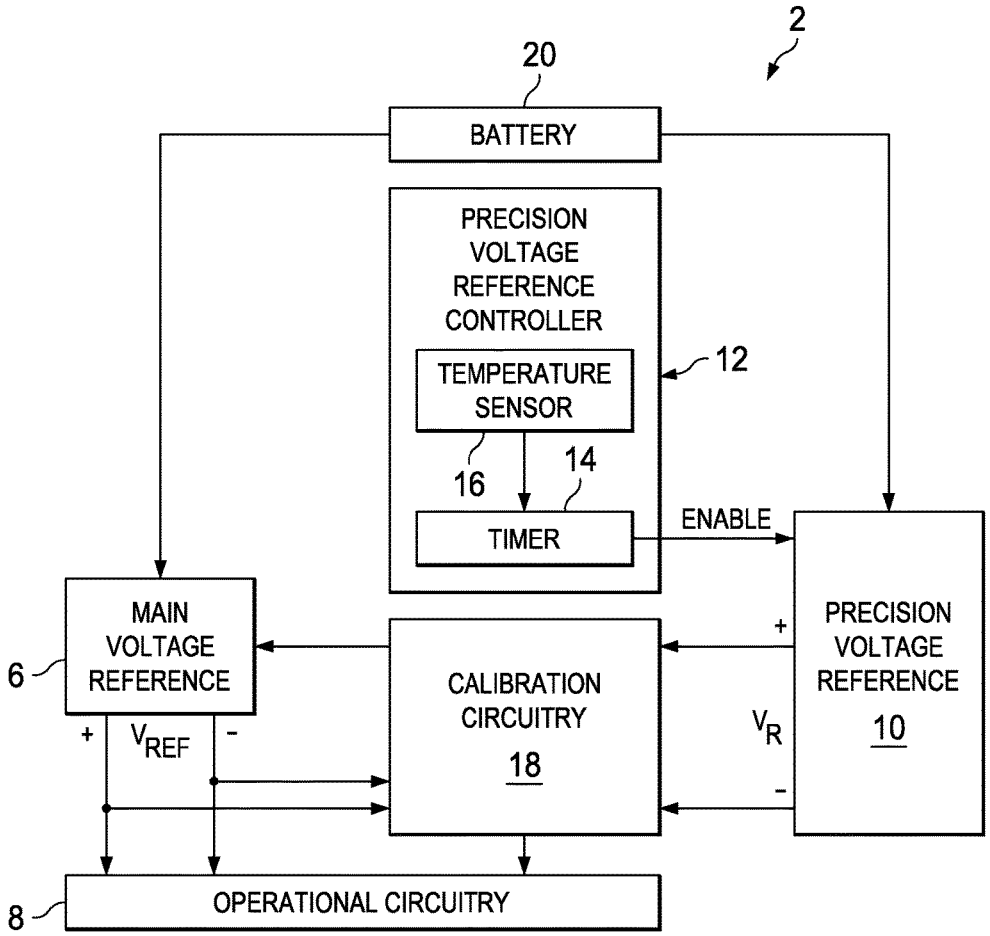
FIG. 1 illustrates selected components of an example electronic circuit, in accordance with embodiments of the present disclosure.

FIG. 1 illustrates selected components of an example electronic circuit 2, in accordance with embodiments of the present disclosure. As shown in FIG. 1, electronic circuit 2 may comprise a main voltage reference 6 for providing a reference voltage $V_{REF}$ to operational circuitry 8 (e.g., a delta-sigma modulator, analog-to-digital converter; digital-to-analog converter, etc.) of electronic circuit 2. Furthermore, electronic circuit 2 may include a precision voltage reference 10. In some embodiments, precision voltage reference 10 may have higher precision than main voltage reference 6, but may consume more power when operating as compared to main voltage reference 6. When operating, precision voltage reference 10 may generate a reference voltage $V_R$ to calibration circuitry 18. Calibration circuitry 18 may be configured to perform a comparison of reference voltage $V_{REF}$ and reference voltage $V_R$ and based on such comparison, perform a calibration to account for the difference between reference voltage $V_{REF}$ and reference voltage $V_R$. For example, such calibration may include calibration circuitry 18 controlling main voltage reference 6 to modify reference voltage $V_{REF}$ such that reference voltage $V_{REF}$ matches reference voltage $V_R$. As another example, calibration may include calibration circuitry 18 controlling operational circuitry 8 to modify one or more parameters (e.g., a signal gain) of operational circuitry 8 to compensate for a difference between reference voltage $V_{REF}$ and reference voltage $V_R$.

As shown in FIG. 1, precision voltage reference 10 may be controlled by a precision voltage reference controller 12.

In general, precision voltage reference controller 12 may determine a presence or an absence of a condition for calibrating main voltage reference 6 and, responsive to the presence of the condition, enable precision voltage reference controller 12 (e.g., power on precision voltage reference 10) to generate reference voltage $V_R$ for calibrating main voltage reference 6. On the other hand, responsive to the absence of the condition, precision voltage reference controller 12 may disable (e.g., power off precision voltage reference 10) precision voltage reference 10. As shown in FIG. 1, precision voltage reference controller 12 may comprise a timer 14 and a temperature sensor 16. In operation, timer 14 may generate a periodic signal (e.g., square wave) that periodically enables and disables precision voltage reference 10. In some embodiments, such periodic signal may have a low duty cycle (e.g., 1%-2%) such that precision voltage reference 10 is typically disabled, but is occasionally enabled for a short period of time (e.g., 1 second for every 100 second period of timer 14) to allow for calibration of main voltage reference 6 to precision voltage reference 10. Thus, in such embodiments, the condition for calibrating main voltage reference 6 comprises a passage of a duration of time from a previous calibration of main voltage reference 6. In some of such embodiments, the frequency of timer 14 may vary in accordance with a rate of change of a temperature measured by temperature sensor 16. For example, when a magnitude of a rate of change of a temperature measured by temperature sensor 16 increases, the frequency of timer 14 may increase, and when the magnitude of the rate of change of the temperature measured by temperature sensor 16 increases, the frequency of timer 14 may decrease. In these and other embodiments, the condition for calibrating main voltage reference 6 may include a change in temperature as sensed by temperature sensor 16. For example, responsive to a change of a magnitude of the temperature above a threshold change, temperature sensor 16 may "override" timer 14 to enable precision voltage reference 10 in order to trigger a calibration in response to such temperature change.

By providing a precision voltage reference 10 within the same circuit 2 as main voltage reference 6, calibration of main voltage reference 6 with precision voltage 10 may always be available when needed by main voltage reference 6. In addition, because precision voltage reference 10 may only be enabled in response to passage of time, changes in temperature, and/or changes in the rate of change in temperature, such calibration may be performed only as needed.

As shown in FIG. 1, main voltage reference 6, precision voltage reference 10, and/or other components of electronic circuit 2 may be powered from a battery 20.

Figure 2:
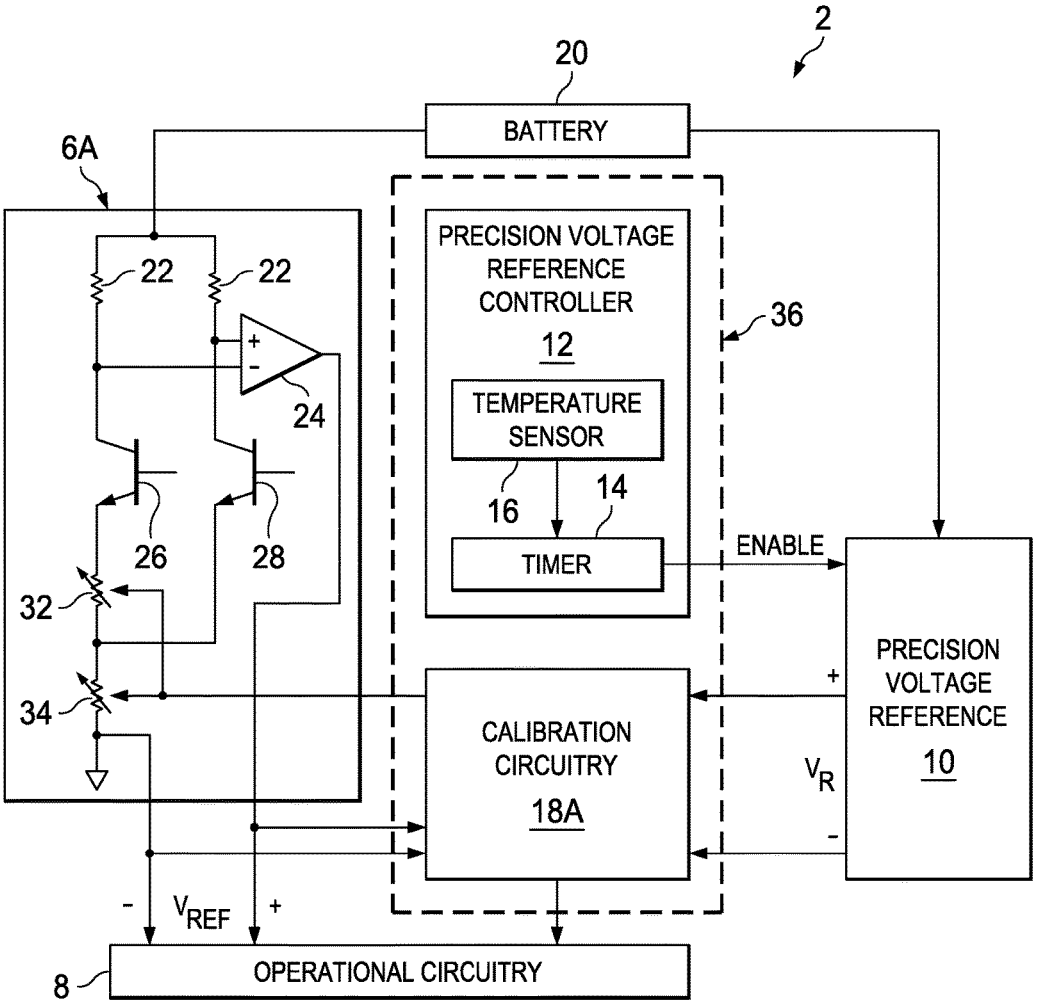
FIG. 2 illustrates selected components of an example electronic circuit with detail calibration of a particular voltage reference, in accordance with embodiments of the present disclosure.

FIG. 2 illustrates selected components of an example electronic circuit 2A, which may implement all or a portion of example electronic circuit 2, with detail showing selected components of a main voltage reference 6A, in accordance with embodiments of the present disclosure. In the example embodiment of FIG. 2, main voltage reference 6A is implemented as a Brokaw bandgap voltage reference having resistors 22, operational amplifier 24, bipolar-junction transistor 26, bipolar-junction transistor 28, variable resistor 32, and variable resistor 34 arranged as shown. As is known in the art, resistors 22 may have an approximately equal resistance, and transistor 26 may have a substantially larger current density than that of transistor 28.

In operation example electronic circuit 2A, when precision voltage reference 10 is enabled, calibration circuitry 18A may compare reference voltage $V_{REF}$ to reference voltage $V_R$ and based on the comparison, modify resistances of either or both of variable resistor 32 and variable resistor 34 to minimize the error between reference voltage $V_{REF}$ and reference voltage $V_R$. In these and other embodiments, calibration circuitry 18A may modify characteristics of other components of main voltage reference 6A in order to undertake calibration, including without limitation transistor 26, transistor 28, resistors 22, and operational amplifier 24.

In some embodiments, some components of electronic circuit 2A (e.g., precision voltage reference controller 12, and calibration circuitry 18A) may be integral to a single integrated circuit 36, while other components may be external to integrated circuit 36.

Figure 3:
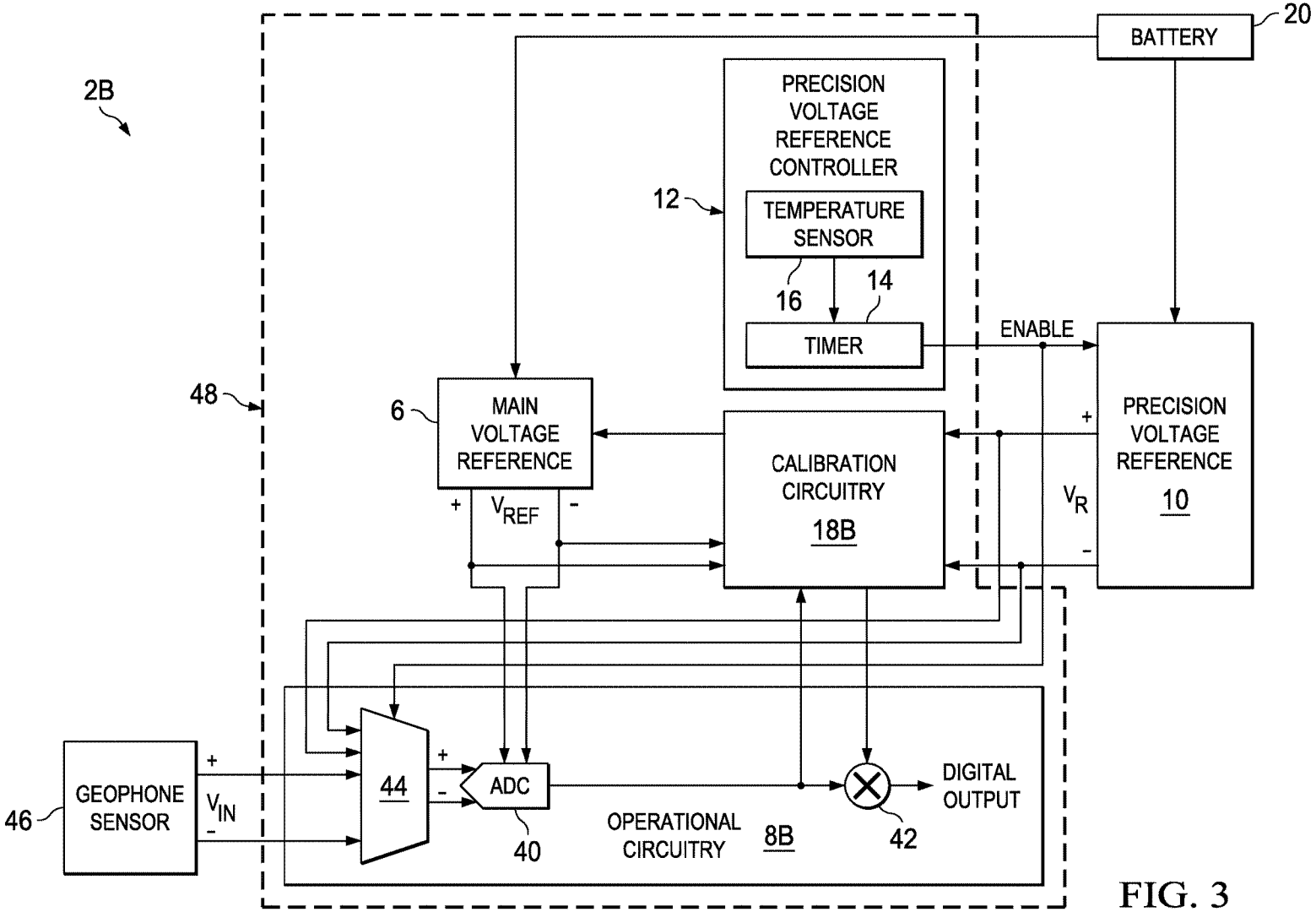
FIG. 3 illustrates selected components of an example electronic circuit with detail showing digital calibration of a voltage reference, in accordance with embodiments of the present disclosure.

FIG. 3 illustrates selected components of an example electronic circuit 2B with detail showing digital calibration of main voltage reference 6, in accordance with embodiments of the present disclosure. As shown in FIG. 3, operational circuitry 8B may include an analog-to-digital converter (ADC) 40 configured to sample analog data and convert it to a digital signal. For example, in some embodiments, ADC 40 may be part of a data acquisition system configured to acquire data from a sensor, such as a geophone sensor 46 or other seismic sensor. In operation, when precision voltage reference 10 is disabled, multiplexer 44 may pass an input analog signal $V_{IN}$ which may be processed by ADC 40 and converted into a digital signal. However, during a calibration phase in which precision voltage reference 10 is enabled, multiplexer 44 may pass a reference voltage $V_R$ which may be processed by ADC 40 and converted into a digital signal. If main voltage reference 6 is generating a reference voltage $V_{REF}$ for ADC 40 which is equal to reference voltage $V_R$, then ADC 40 would be expected to output a digital signal having a particular ideal value. Any deviations from the particular ideal value would correlate to an error in reference voltage $V_{REF}$. Thus, calibration circuitry 18B may receive the digital signal generated from applying reference voltage $V_R$ to the input of ADC 40, determine if it deviates from the particular ideal value, and adjust a gain of a gain element 42 to compensate for the deviation.

In some embodiments, some components of electronic circuit 2B (e.g, precision voltage reference controller 12, and calibration circuitry 18B, main voltage reference 6, and operational circuitry 8B) may be integral to a single integrated circuit 48, while other components may be external to integrated circuit 48.

Figure 4:
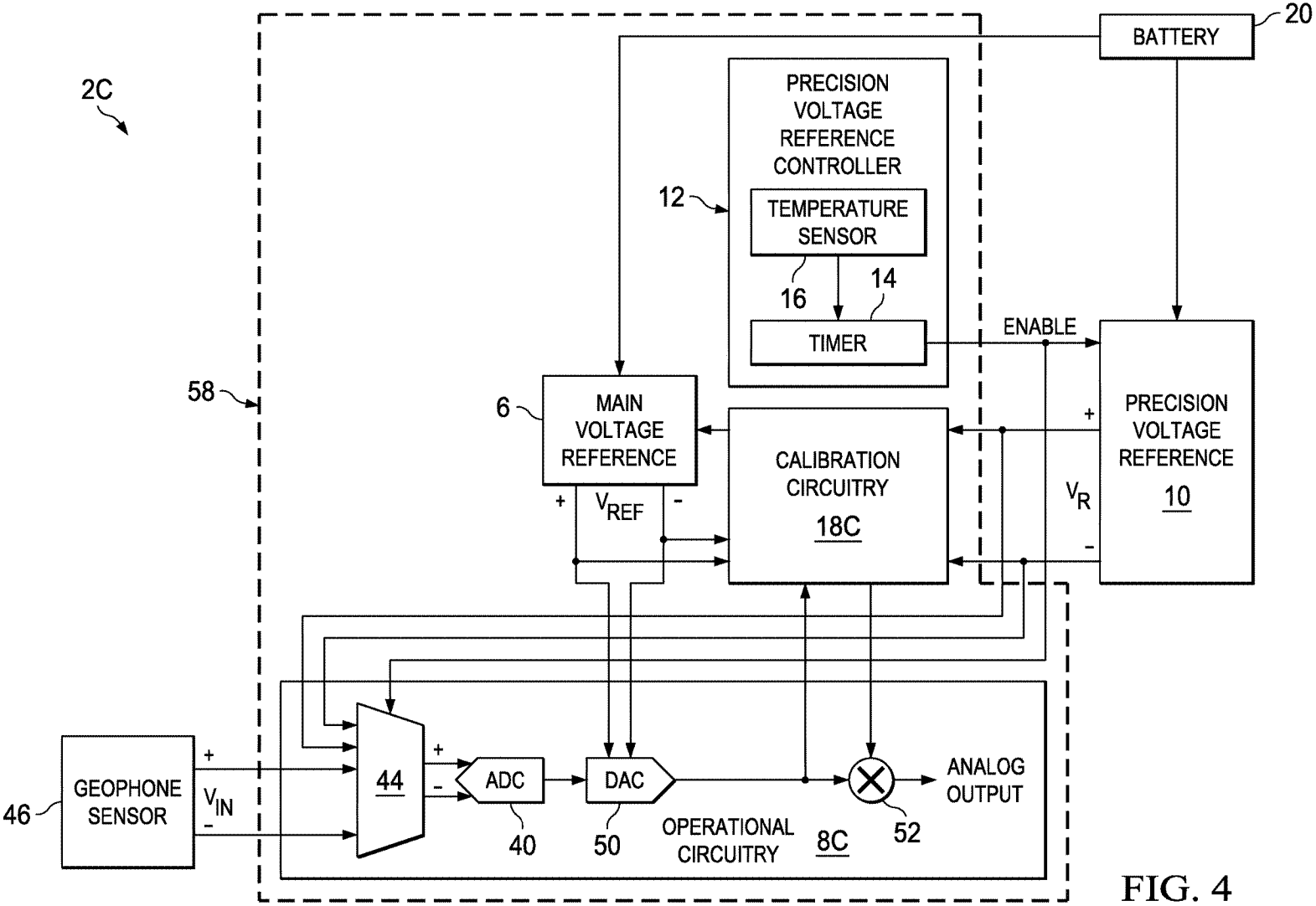
FIG. 4 illustrates selected components of another example electronic circuit with detail showing digital calibration of a voltage reference, in accordance with embodiments of the present disclosure.

FIG. 4 illustrates selected components of another example electronic circuit 2C with detail showing digital calibration of main voltage reference 6, in accordance with embodiments of the present disclosure. As shown in FIG. 4, operational circuitry 8C may include an analog-to-digital converter (ADC) 40 configured to sample analog data and convert it to a digital signal, and a digital-to-analog converter (DAC) 50 configured to convert the digital signal into an analog signal. In operation, when precision voltage reference 10 is disabled, multiplexer 44 may pass an input analog signal $V_{IN}$ which may be processed by ADC 40 and converted into a digital signal, and transmitted over a transmission line, after which it may then converted into a corresponding analog signal by DAC 50. However, during a calibration phase in which precision voltage reference 10 is enabled, multiplexer 44 may pass a reference voltage $V_R$ which may be processed by ADC 40 and converted into a digital signal and then converted to a corresponding analog signal by DAC 50. If main voltage reference 6 is generating a reference voltage $V_{REF}$ for DAC 50 which is equal to reference voltage $V_R$, then DAC 50 would be expected to output an analog signal having a particular ideal value. Any deviations from the particular ideal value would correlate to an error in reference voltage $V_{REF}$. Thus, calibration circuitry 18C may receive the analog signal generated from applying reference voltage $V_R$ to the input of ADC 40, determine if it deviates from the particular ideal value, and adjust a gain of a gain element 52 to compensate for the deviation.

In some embodiments, some components of electronic circuit 2C (e.g, precision voltage reference controller 12, calibration circuitry 18C, main voltage reference 6, and operational circuitry 8C) may be integral to a single integrated circuit 58, while other components may be external to integrated circuit 58.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the exemplary embodiments herein that a person having ordinary skill in the art would comprehend. Similarly, where appropriate, the appended claims encompass all changes, substitutions, variations, alterations, and modifications to the exemplary embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A controller configured to:

determine a presence or an absence of a condition for calibrating a first voltage reference for generating a first voltage for operating a circuit, wherein the condition includes an expiration of a timer indicative of a passage of time from a previous calibration of the first voltage reference, and wherein a time duration associated with the timer depends upon a rate of change of a temperature associated with the circuit;

responsive to the presence of the condition, enable a second voltage reference to generate a second voltage for calibrating and controlling the first voltage wherein the second voltage reference has a higher precision than the first voltage reference; and responsive to the absence of the condition, disable the second voltage reference.

2. The controller of claim 1, wherein the circuit comprises an analog-to-digital converter.

3. The controller of claim 2, wherein the analog-to-digital converter is integral to an integrated circuit comprising the first voltage reference and the controller.

4. The controller of claim 2, wherein the analog-to-digital converter is integral to a data acquisition system.

5. The controller of claim 2, wherein the analog-to-digital converter is configured to sample data from a seismic sensor.

6. The controller of claim 1, wherein the first voltage reference and the second voltage reference are configured to receive electrical energy for operation from a battery.

7. A method comprising:

determining a presence or an absence of a condition for calibrating a first voltage reference, the first voltage reference for generating a first voltage for operating a circuit, wherein the condition includes an expiration of a timer indicative of a passage of time from a previous calibration of the first voltage reference, and wherein a time duration associated with the timer depends upon a rate of change of a temperature associated with the circuit;

responsive to the presence of the condition, enabling a second voltage reference to generate a second voltage for calibrating and controlling the first voltage, the second voltage reference having higher precision than the first voltage reference; and responsive to the absence of the condition, disabling the second voltage reference.

8. The method of claim 7, wherein the circuit comprises an analog-to-digital converter.

9. The method of claim 8, wherein the analog-to-digital converter is integral to an integrated circuit comprising the first voltage reference and the controller.

10. The method of claim 8, wherein the analog-to-digital converter is integral to a data acquisition system.

11. The method of claim 8, wherein the analog-to-digital converter samples data from a seismic sensor.

12. The method of claim 7, wherein the first voltage reference and the second voltage reference receive electrical energy for operation from a battery.

13. A system comprising:

a first voltage reference for generating a first voltage for operating a circuit;

a second voltage reference having higher precision than the first voltage reference; and a controller configured to:

determine a presence or an absence of a condition for calibrating the first voltage reference, wherein the condition includes an expiration of a timer indicative of a passage of time from a previous calibration of the first voltage reference, and wherein a time duration associated with the timer depends upon a rate of change of a temperature associated with the system;

responsive to the presence of the condition, enable the second voltage reference to generate a second voltage for calibrating and controlling the first voltage reference; and responsive to the absence of the condition, disable the second voltage reference.

* * * * *